US006064718A

United States Patent [19]

Holland et al.

[11] Patent Number: 6,064,718

[45] Date of Patent: May 16, 2000

[54] FIELD EMISSION TUBE FOR A MOBILE X-RAY UNIT

[75] Inventors: Glenn E. Holland, Wheaton; Craig N. Boyer, Mitchellville, both of Md.; John F. Seely, Lorton, Va.

[73] Assignee: The United States of America as represented by the Secretary of the Navy, Washington, D.C.

[21] Appl. No.: 09/162,150

[22] Filed: Sep. 29, 1998

[51] Int. Cl.[7] ..... H01J 35/00

[52] U.S. Cl. ..... 378/122; 378/119; 378/121; 378/123

[58] Field of Search ..... 378/119, 121, 378/122, 123, 136

[56] References Cited

U.S. PATENT DOCUMENTS

| | | | |
|---|---|---|---|
| 3,283,203 | 11/1966 | Dyke et al. | 378/122 |
| 3,309,523 | 3/1967 | Dyke et al. | 378/122 |
| 3,783,288 | 1/1974 | Barbour et al. | 378/106 |
| 3,883,760 | 5/1975 | Cunningham, Jr. | 378/122 |
| 3,970,884 | 7/1976 | Golden | 378/122 |
| 4,012,656 | 3/1977 | Norman et al. | 378/122 |
| 4,379,977 | 4/1983 | Carmel et al. | 378/136 |
| 4,495,442 | 1/1985 | Minami | 315/3 |
| 4,835,391 | 5/1989 | Hartemann et al. | 250/361 R |
| 4,964,148 | 10/1990 | Klostermann et al. | 378/127 |
| 5,056,126 | 10/1991 | Klostermann et al. | 378/127 |
| 5,469,490 | 11/1995 | Golden et al. | 378/122 |
| 5,651,045 | 7/1997 | Pouvesle et al. | 379/119 |
| 5,854,822 | 12/1998 | Chornenky et al. | 378/122 |

*Primary Examiner*—David P. Porta
*Assistant Examiner*—Allen C Ho
*Attorney, Agent, or Firm*—Barry A. Edelberg; Charles J. Stockstill

[57] ABSTRACT

A field emission X-ray tube is provided for use in a mobile X-ray machine. An evacuated ceramic housing having a convoluted interior shape for dissipating sparks surrounds the components of the field emission tube. A cathode and, an anode which emits x-rays, are located within the ceramic housing. A hollow anode tube is connected to the anode at one end and a vacuum pinch off element at the other end. Stray radiation is attenuated by a lead ring positioned inside of the ceramic housing.

19 Claims, 2 Drawing Sheets

FIELD EMISSION TUBE FOR A MOBILE X-RAY UNIT

This application is related to U.S. application Ser. No. 08/738,927, filed Oct. 28, 1996, now abandoned the disclosure of which is hereby incorporated by reference.

BACKGROUND OF THE INVENTION

1. Field of the Invention

The present invention relates to field emission tubes and, more particularly, to field emission tubes for use as part of a mobile battery operated X-ray machine.

2. Related Art

X-ray machines that generate X-rays from cold field emission of electrons from the cathode of an X-ray tube are commonly employed in pulsed shadowgraph radiographs. Pulsed or flash shadowgraph radiograph was developed in 1938 as a means for observing extremely rapid motion where the subject was obscured from observation with visible light or debris. To date, flash radiography remains the principal means of observing lensed implosions and ballistic impacts over microsecond and nanosecond time scales. The majority of these X-ray systems utilize the well known Marx generator which can be viewed as a distributed transmission-storage line, consisting of n-cascaded high-voltage ceramic disc capacitors, such as barium titanate, strontium titanate or any other suitable material that has a high dielectric constant. To produce X-rays, the Marx generator is coupled to a field emission X-ray tube either directly or by coaxial cables.

In copending commonly assigned application Ser. No. 08/738,927, the present inventors disclose a mobile X-ray machine which is of the type described above and an embodiment of which is illustrated in FIG. 1. The mobile X-ray machine, which is generally denoted 10, basically comprises two aluminum enclosures 12 and 14, wherein enclosure 12 houses a field emission X-ray tube assembly 16 and a Marx generator 18, and enclosure 14 houses control electronics 20.

Considering the Marx generator 18 in more detail, a plurality of ceramic disc capacitors C1–C10 operate together with a plurality of spark-gap switches G1–G10. The capacitors C1–C10 contained in the Marx generator 18 are charged to a high voltage (H.V.) in parallel via bleeder resistors in a resistor chain (not shown). Each of the spark gap switches G1–G10 consists of two closely spaced spherical electrodes. The spark gap switches are arranged so that each charged capacitor C1–C10 in the Marx generator 18 is isolated from all other capacitors via the bleeder resistors. The spark gap switches G1–G10 are mounted along a common optical axis (not shown) together with an ultraviolet photoionization device or source 22, connected to the control electronics 20, and mounted in close proximity to the first spark gap switch G1, within the Marx generator 18. Triggering of the Marx generator 18 begins with the control electronics 20 which initiates a high voltage trigger pulse which triggers ultraviolet photoionization source 22 by way of connection path 24. In response, the U.V. photoionization source 22 emits a large flash of hard U.V. radiation. The hard U.V. radiation emitted from device 22 photoionizes spark gap G1, and the closure of this switch places the first capacitor in the Marx generator C1 in series with the second capacitor C2 in the generator 18 thereby doubling the voltage across the second spark gap switch G2. The increased voltage stress across the second spark gap together with the hard ultraviolet illumination it receives from the closure of the first spark gap switch G1 causes the second spark gap to break down quickly. This process continues at an accelerating rate until all capacitors C1–C10 in the Marx generator 18 are fully connected in series. The full Marx voltage now appears across switch G10 which is connected to a power feedthrough device 26.

Briefly considering the X-ray tube assembly 16, power feedthrough device 26 transmits the H.V. output of the Marx capacitors to the anode 28 of the X-ray tube 16, via anode tube 29. The X-ray tube assembly 16 is held within the enclosure 30 by the clamping arrangement 32. When high voltage (H.V.) pulses arrive at the anode 28 of the X-ray tube 16 these pulses establish a large potential gradient in the anode-cathode gap. This gradient produces an intense electric field at the tips of the small metal whiskers which are present on the surface of the cathode mesh 34. The whiskers (not shown) are heated by the passage of the field emission electron current and vaporize, creating a neutral plasma which acts as a virtual cathode capable of supporting a much larger current. Electrons emitted from the expanding virtual cathode are accelerated by the electric field in the anode-cathode gap and eventually collide with the anode 28 creating X-rays by the usual Bremmstrahlung and line radiation processes. Electrons continue to cross the anode-cathode gap until the X-ray tube impedance drops to a few ohms and effectively shorts the tube.

The X-ray tube or field emission tube 16 illustrated in FIG. 1 is described in more detail in the aforementioned copending application Ser. No. 08/738,927.

SUMMARY OF THE INVENTION

Although the X-ray tube described above is effective in carrying out its intended purpose, it is an object of the invention to provide a more compact, lighter and reusable field emission tube for use in a mobile X-ray machine.

In accordance with a first aspect of the invention, a field emission tube is provided which includes: an evacuated ceramic housing having a convoluted interior shape for dissipating sparks; a cathode mounted within said ceramic housing; an anode located within the ceramic housing for emitting x-rays; a vacuum pinch-off means, located at one end of the housing and adapted to be connected to a vacuum source for, when pinched off, sealing off the field emission tube; a hollow anode tube having a first end connected to the anode and a second end connected to the vacuum pinch off means; and a lead ring positioned inside of said ceramic housing, for attenuating stray radiation.

The field emission tube preferably includes a getter material located within the ceramic housing. Advantageously, the getter material is located adjacent to the anode tube. In a preferred embodiment, the anode tube includes holes arranged in a spiral arrangement for allowing gases to pass therethrough and exit out of the vacuum pinch-off means and the getter material comprises a cylinder surrounding a portion of the anode tube in which the holes are provided.

The vacuum pinch-off means preferably comprises a sealable metal tube element 50 and, more preferably, a soft copper tube.

The field emission tube 36 also preferably includes a metal cap 60, such as brass, aluminum, titanium, copper, stainless steel or plate material positioned over the vacuum pinch-off means for protecting the vacuum pinch-off means and providing an electrical contact between the field emission tube and an external power supply.

In another preferred implementation of the first embodiment, the anode 38 is formed of an alloy of copper and tungsten and the cathode 40 is a stainless steel mesh or pattern etched foil.

In accordance with a further aspect of the invention, a mobile X-ray machine is provided which includes the field emission tube described above in combination with a Marx generator. connected to the field emission tube.

Other features and advantages of the invention will be set forth in, or apparent from, the following detailed description of the preferred embodiments of the invention.

DESCRIPTION OF THE PREFERRED EMBODIMENTS

Figure 2:
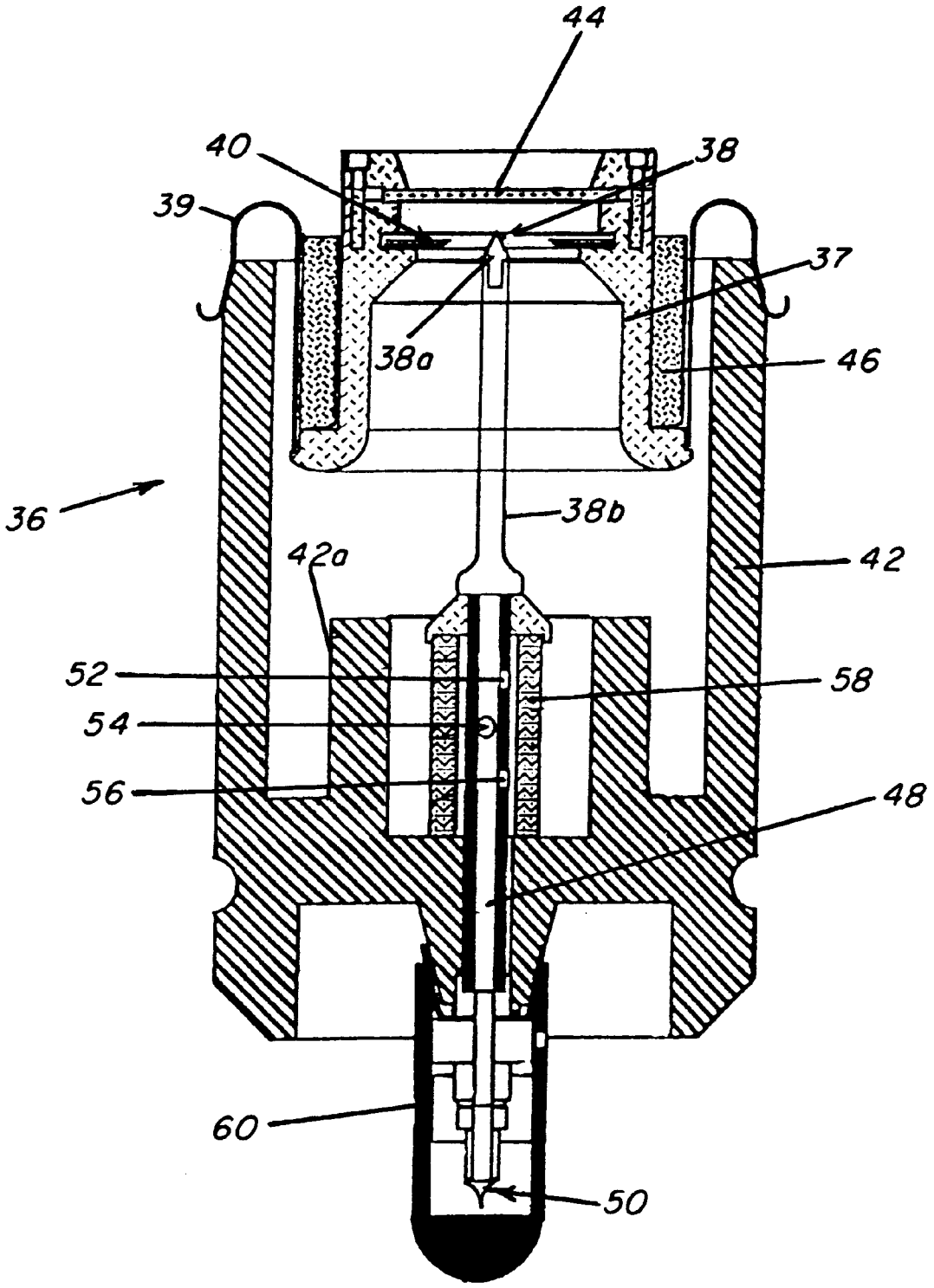
FIG. 2 is a cross-sectional view of a field emission tube in accordance with a preferred embodiment of the invention.

Referring to FIG. 2, there is shown a field emission tube in accordance with a preferred embodiment of the invention. Field emission tube 36 is generally of the type comprised of a geometric arrangement of an anode 38 and a cathode 40 derived from the well known "Siemens-tube" configuration. The field emission tube 36 includes an anode 38 which has a conical copper/tungsten anode tip 38*a* and an elongated anode body 38*b*, and a perforated cathode 40 preferably punched out from or otherwise formed by a metal mesh or foil such as copper, BeCu, Ti, stainless steel, Zr, or other suitable metal. Anode 38 and cathode 40 are mounted within a generally cylindrical support member 37 supported by a sealing element or member 39, preferably made of Kovar, at one end of a ceramic housing 42. A vacuum window 44, preferably made of aluminum or the like, is mounted at the distal end of support member 37 in spaced parallel relation to cathode 40. The vacuum window 44 is preferably a 0.1 mm thick aluminum x-ray window. As illustrated, the interior of the ceramic housing 42 has a convoluted shape at the bottom of the housing provided by an inwardly spaced wall 42*a*. This convoluted shape provides an extended spark creep path which extends along the inner surface of the outer wall of housing 42, the outer surface of the inner wall 42*a* and the inner surface of the inner wall 42*a* and thus assists in dissipating sparks.

The radiation extracted from the field emission tube 36 travels along the longitudinal axis thereof and, as a result of the provision of conical anode tip 38*a*, the emitting area is about 1–2 mm in diameter. Application of a high voltage across the anode-cathode gap of the field emission tube 36 under good vacuum produces an intense electric field between the wires in the mesh of the cathode 40 and the surface of conical shaped anode 38. This electric field extracts electrons from the cathode 40 by the process of cold field emission. The electrons accelerate from the cathode 40 towards the anode 38 where the electrons collide and produce Bremmstrahlung and K-line radiation in the X-ray wavelength range. This radiation continues until the plasma produced at the cathode 40 crosses the gap and shorts out the tube 36. Plasma closure in one preferred embodiment of the field emission tube 36 sets the X-ray pulse width at about 50 nanoseconds. This field emission process allows for dual energy output in a single pulse. By correctly choosing the anode material, useful energy bands may be selected.

The X-rays pass through the vacuum window 44 and travel toward the desired target. However, all of the radiation does not travel toward the vacuum window 44. Some stray radiation travels in a direction perpendicular to the longitudinal tube axis. A lead ring or annulus 46 is mounted in surrounding relation around the support member 37 supported within the ceramic housing 42 and extends over an upper portion of the length of anode 38 so as to attenuate stray radiation. It is noted that placing the lead ring 46 within the ceramic housing 42, as opposed to outside of a ceramic housing as in prior art devices, permits the use of a smaller diameter and thus lighter lead ring and contributes to the overall reduction in weight of the field emission tube 36 as compared with such devices.

An anode tube 48 provides an electrical connection between the anode 38 and an external power supply (not shown). The anode tube 48 preferably comprises a tubular member having a typical outer diameter of 0.24 inches and a typical inner diameter of 0.125 inches. The anode tube 48 is also used during the evacuation of the field emission tube 36, together with a vacuum pinch-off element 50 located at the opposite end of field emission tube 36 from anode 38. The field emission tube 36 is evacuated through the center of the anode tube 48. In this operation, a vacuum source (not shown) is attached to the vacuum pinch-off element 50. The vacuum pinch-off element 50 is replaceable and allows the field emission tube 36 to be opened for maintenance and then resealed. In a preferred embodiment, the vacuum pinch-off element 50 is formed from a tube of soft copper or other metal, in contrast with the glass pinch-off elements of the prior art. The provision of such a metal pinch-off element contributes to the reusability of the field emission tube.

During the vacuum evacuation process, gasses inside the field emission tube 36 travel through a series of holes 52, 54 and 56 formed in the side walls of anode tube 48 and exit through the vacuum pinch-off element 50. Holes 52, 54 and 56 are preferably arranged in a spiral pattern so as not to unduly weaken the walls of anode tube 48. Prior to the evacuation process, all of the components within the ceramic housing 42 are cleaned and vapor degreased. In one preferred example, the field emission tube 36 was pumped down to $\sim 4\times10^{-8}$ torr and baked to promote de-absorption of wall contaminates. The contaminates on the surfaces of anode 38 and cathode 40 can further be removed by repeatably discharging the field emission tube 36 during the evacuation process.

In the illustrated embodiment, a cylinder of getter material 58 is disposed inwardly of inner wall 42*a* of the housing 42, in adjacent, surrounding relation to the anode tube 48, and in the vicinity of holes 52, 54 and 56. Getter material 58 acts to bind any gasses not evacuated out through the vacuum pinch-off element 50.

The vacuum pinch-off element 50 is protected by a cap 60. The cap 60 also serves as an electrical contact between the anode tube 48 and the external power supply (not shown).

Figure 1:
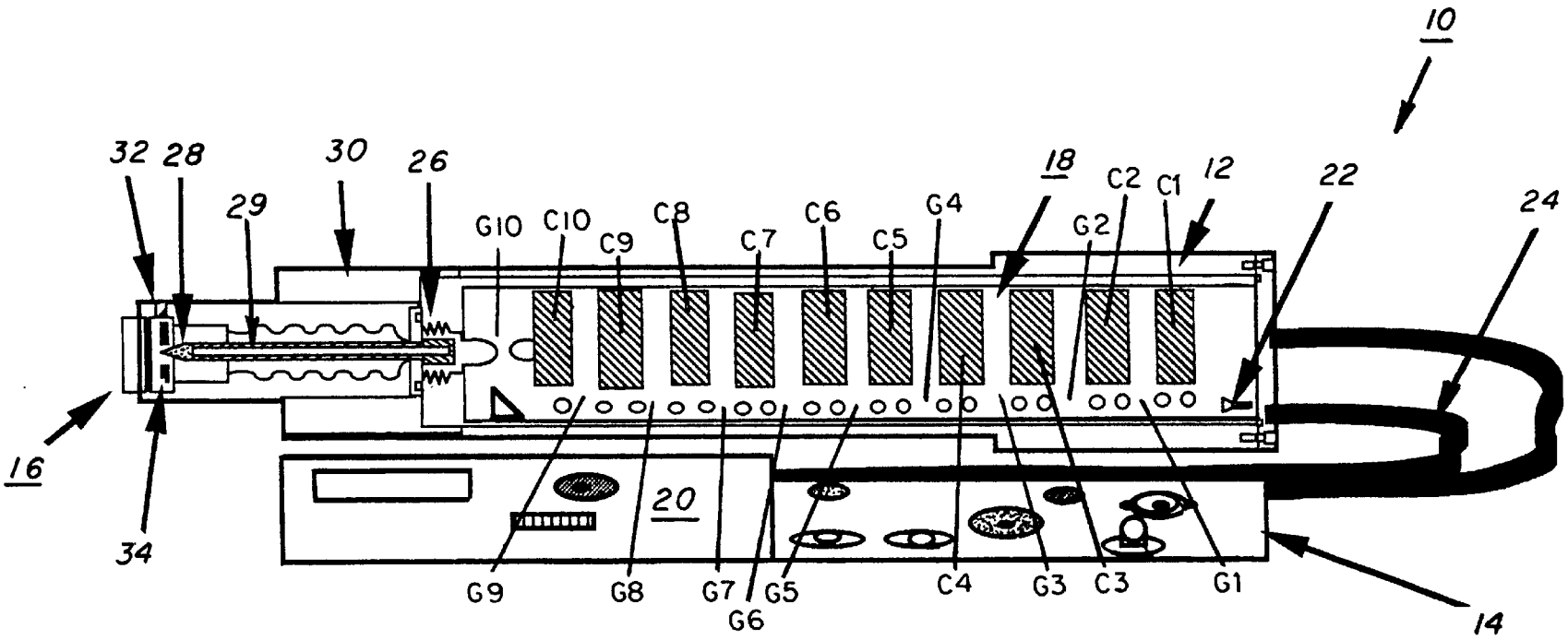
FIG. 1, which was described above, is a schematic diagram of a mobile X-ray machine incorporating a related field emission tube construction.

It will be appreciated that field emission tube 36 is intended to replace x-ray tube 16 of FIG. 1 and would be connected to, and supported by, the x-ray machine of FIG. 1 in the same way as tube 16. In an exemplary embodiment, the field emission tube 36 is preferably powered by a 200 kV Marx generator of the type shown in FIG. 1 and delivers an exemplary total integrated x-ray dose of about 94 milliroentgens at 30 cm with a repeatability of ±2%.

Although the invention has been described in detail with respect to preferred embodiments thereof, it will be apparent to those skilled in the art that variations and modifications can be effected in these embodiments without departing from the spirit and scope of the invention. For example, the field emission tube of the invention may be used for general diagnostic radiography, and as a dual energy source for precision bone mineral density (BMD) measurements.

We claim:

1. A reusable field emission x-ray tube comprising:

an evacuated ceramic housing having a convoluted interior shape for dissipating sparks;

a cathode mounted within said ceramic housing;

an anode located within said ceramic housing for emitting x-rays;

a vacuum pinch-off means, located at one end of said housing and adapted to be connected to a vacuum source for, when pinched off, sealing off the field emission tube;

a hollow anode tube having a first end connected to said anode and a second end connected to said vacuum pinch off means; and a lead ring, positioned inside of said ceramic housing, for attenuating stray radiation.

2. The field emission x-ray tube according to claim 1, further including:

a getter material located within said ceramic housing.

3. The field emission x-ray tube according to claim 2, wherein:

said getter material is located adjacent to said anode tube.

4. The field emission x-ray tube according to claim 1, wherein:

said anode tube includes a plurality of holes arranged in a spiral arrangement for allowing gases to pass therethrough and to exit out of said vacuum pinch-off means; and said getter material comprises a cylindrical member mounted adjacent to said plurality of holes and in surrounding relation to said anode tube.

5. The field emission x-ray tube according to claim 1, wherein:

said vacuum pinch-off means comprises a sealable metal tube element.

6. The field emission x-ray tube according to claim 5, wherein:

said sealable metal tube comprises a sealable soft tube element selected from the group consisting of Cu, Al, Ni, an alloy of BeCu, stainless steel and combinations thereof.

7. The field emission x-ray tube according to claim 1, further including:

a conductive cap positioned over said vacuum pinch-off means for protecting said vacuum pinch-off means and providing an electrical contact between said field emission tube and an external power supply.

8. The field emission x-ray tube according to claim 1, wherein:

said anode is formed of an alloy of copper and tungsten.

9. The field emission x-ray tube according to claim 1, wherein:

said cathode comprises a stainless steel mesh or pattern etched metal foil.

10. The field emission x-ray tube according to claim 1, wherein:

said field emission tube further comprises a cylindrical support member disposed at one end of said tube;

said cathode comprises a perforated cathode supported by said support member and extending transversely to the longitudinal axis thereof and having a longitudinal axis concentric with the longitudinal axis of the tube;

said anode comprises a conical tip and an elongated portion concentric with the longitudinal axis of the support member; and wherein said lead ring is mounted in said support member in surrounding relationship thereto.

11. A mobile x-ray machine comprising:

a field emission tube comprising:

an evacuated ceramic housing having a convoluted interior shape for dissipating sparks;

a cathode mounted within said ceramic housing;

an anode located within said ceramic housing for emitting x-rays;

a vacuum pinch-off means, located at one end of said housing and adapted to be connected to a vacuum source for, when pinched off, sealing off the field emission tube;

a hollow anode tube having a first end connected to said anode and a second end connected to said vacuum pinch off means;

a lead ring positioned inside of said ceramic housing for attenuating stray radiation; and a Marx generator connected to said field emission tube.

12. The mobile x-ray machine according to claim 11, further including:

a getter material located within said ceramic housing.

13. The mobile x-ray machine according to claim 12, wherein:

said getter material is located adjacent to said anode tube.

14. The mobile x-ray machine according to claim 11, wherein:

said anode tube includes a plurality of holes arranged in a spiral arrangement for allowing gases to pass therethrough and exit out of said vacuum pinch-off means; and said getter material comprises a cylindrical member mounted adjacent to said plurality of holes and in surrounding relation to said anode tube.

15. The mobile x-ray machine according to claim 11, wherein:

said vacuum pinch-off means comprises a resealable metal tube.

16. The mobile x-ray machine according to claim 15, wherein:

said resealable metal tube comprises a soft copper tube.

17. The mobile x-ray machine according to claim 11, further including:

a brass cap positioned over said vacuum pinch-off means for protecting said vacuum pinch-off means and providing an electrical contact between said field emission tube and said Marx generator.

18. The mobile x-ray machine according to claim 11, wherein:

said anode is formed of an alloy of copper and tungsten.

19. The mobile x-ray machine according to claim 11, wherein:

said cathode comprises a stainless steel mesh.

* * * * *